United States Patent [19]

Manser et al.

[11] 4,126,945

[45] Nov. 28, 1978

[54] METHOD AND APPARATUS FOR BULK MATERIAL TREATMENT

[75] Inventors: Josef Manser, Uzwil; Georg Dankesreiter, Oberburen, both of Switzerland

[73] Assignee: Gebrueder Buehler AG, Uzwil, Switzerland

[21] Appl. No.: 710,343

[22] Filed: Jul. 30, 1976

[30] Foreign Application Priority Data

Jul. 31, 1975 [CH] Switzerland ..... 9988/75
Jun. 14, 1976 [CH] Switzerland ..... 7495/76

[51] Int. Cl.[2] ..... F26B 3/22; F26B 3/30

[52] U.S. Cl. ..... 34/4; 34/10; 34/17; 34/19; 34/57 C; 34/60

[58] Field of Search ..... 34/1, 4, 10, 17, 19, 34/57 C, 60, 69; 426/467

[56] References Cited

U.S. PATENT DOCUMENTS

| | | | |
|---|---|---|---|
| 3,012,331 | 12/1961 | Oholm et al. | 34/10 |
| 3,063,848 | 11/1962 | Van Gelder | 426/467 |
| 3,528,179 | 9/1970 | Smith | 34/10 |
| 3,771,234 | 11/1973 | Forster et al. | 34/1 |
| 3,849,900 | 11/1974 | Dale et al. | 34/1 Q |

FOREIGN PATENT DOCUMENTS 1,550,402 11/1968 France.

*Primary Examiner*—John J. Camby
*Attorney, Agent, or Firm*—Merchant, Gould, Smith, Edell, Welter & Schmidt

[57] ABSTRACT

A method and apparatus for treatment of bulk material, as e.g. heating to dry pasta (macaroni products), involves turning the individual pieces of bulk material and displacing them relatively to one another during treatment, and takes place in a throughflow fluidized bed. In one form heating is effected with microwaves, a fluidized bed duct acting as wave guide tube. Multistage processes are disclosed, including a pair of sub-steps involving separate heating and subsequent drying, at least the former utilizing microwave heating. The sub-steps can take place in separate treatment ducts which share a common air circulation duct, both the treatment ducts forming an integral unit.

57 Claims, 15 Drawing Figures

FIG. 5
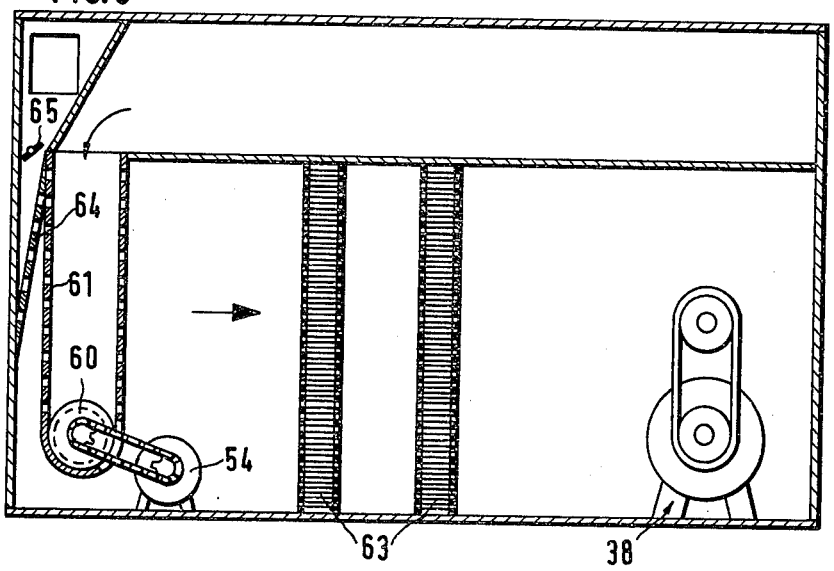
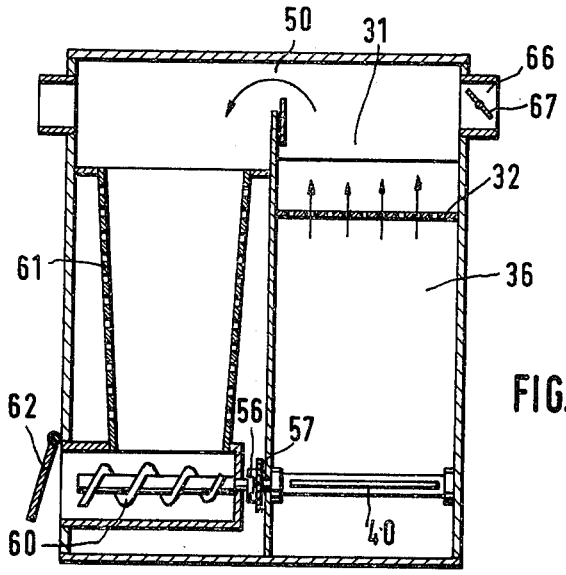
FIG. 6

91
92
93
94
95
96
97
98
99
100
101
102
103
104
105
106
107
XII
XII
92
$E_{max}$
X
Y
Z

METHOD AND APPARATUS FOR BULK MATERIAL TREATMENT

FIELD OF THE INVENTION

The invention relates to a method for the treatment of flour paste or macaroni products (herein generally termed pasta). The invention also relates to apparatus for carrying out the method.

It is known in the art to treat bulk materials with a gas and/or with heat. This may be in order to remove substance or energy from the surface of the individual pieces, for example drying, or to apply substance or energy to the surface of the pieces and to introduce substance or energy into the products through the surface, for example when moistening, impregnating etc.

The drying of pasta includes such a treatment. The technical standards set are high. More particularly the pasta manufacturer has to ensure that each pasta piece after treatment has a uniform physical structure internally. It is known that this is achieved with slow uniform drying, and that it is possible to obviate large internal stresses and the formation of cracking and fractures resulting therefrom.

During or after drying no undesirable bio-chemical processes must be allowed to occur. The cooking behaviour and colour of the pasta must also be in accordance with the quality requirements expected by the market.

The form of the pasta articles produced from the moist paste by the press must not be affected.

Drying includes both pre-drying and also final drying. Pre-drying and final drying can each comprise one or more stages. Each stage can consist of one or more steps.

DESCRIPTION OF THE PRIOR ART

The known drying lines for pasta are usually divided into three constructionally separate units:

shaker pre-dryer
pre-dryer
final dryer.

In the shaker pre-dryer, solidification of the external layer of the pasta simply takes place in a few minutes (formation of crust), so that the pasta has sufficient strength for the subsequent drying.

In the pre-dryer it is possible to remove from the pasta a very large quantity of water over about half an hour throughflow time.

The final dryer requires the largest unit constructionally, in order to expel and remove from the pasta pieces the residual water quantity over about 6 hours to for example a level of 12.5% relative moisture.

In the art concerned it is regarded as a fact that the pasta pieces have to be dried extremely carefully in the pre-drying stage and more particularly in the shaker pre-dryer, and any mechanical stressing of the individual pieces should be prevented or at least kept as small as possible. The consequence is that each piece has to be guided through the pre-drying chambers as if carried along on a pallet, so to speak. It is also known that with unsuitable regulation of temperature and moisture in the drying air the pasta pieces may again assume a soft pasty quality after a first solidification, and there is still a risk of deformation and sticking together even in the final drying section.

In practice these problems have been solved by feeding the pasta pieces in only a single layer carefully on to a screen with air blowing through it during pre-drying. The screen has fine shaking movements imparted to it, and thus the onward movement of the pasta pieces is obtained. In this way, deformation of the pieces is prevented. The subsequent drying stage is somewhat more difficult owing to the less favourable conveyance of liquid from the interior of the pasta pieces through the solidified outer skin to the surface. This is not regarded as a disadvantage, since the subsequent drying in any case has to be carried out carefully and with small moisture and temperature differences between air and pasta piece, to prevent harmful phenomena such as discoloration, cracking or re-softening etc.

The drying operation for pasta goods in fact involves relatively large mass flows of a large number of small pieces of the bulk material concerned. Each piece in the mass flow must be given the same sufficiently long time to obtain the desired result.

In practical work an average drying time of about 7 hours can be expected for example for small conical pasta shells, to dry them to about 12.5% water content from about 32%. Because of the initially only very low bed height there is a total drying distance of the order of magnitude of 150 m. (meters). In order that the drying time does not become too long and so that heat losses can be minimised, the dryers have several floors in a unit, either a plurality of drying belts or a plurality of screen pallets.

The transfer from one belt to the next or from one screen to the next is regarded as advantageous since in this way after each drying section a small change in position is necessarily brought about for each pasta piece. Still, by choosing suitable speeds for the conveyor belts and smooth transitions, mechanical pressing or squeezing of individual pieces is substantially prevented.

The person skilled in the art knows a number of further factors for the operation of dryers. For example different conditions regarding the width of a belt etc. which can be dealt with reliably only with still lower belt speeds, temperature differences etc., so that for a given installation only a relatively small throughput capacity is achieved as compared with drying operations in other branches of industry.

It is also known for bulk materials which are to be dried or the like to be passed on a conveyor belt or in a throughflow fluidised bed in a longitudinal direction through a microwave waveguide tube, and then to be heated. More particularly when drying it has been found that with delicate bulk materials such as pasta, local overheating with burning may occur if the installation operates with a high microwave energy density. Therefore, up to the present, the drying has to be carried out with a low microwave generator power and therefore a low drying rate (kilograms dry material per unit of time), for which reason such methods have not been successfully adopted into widespread use for the drying of pasta.

OBJECTS OF THE INVENTION

The present invention has as its object to allow the treatment medium or media to act as uniformly as possible during treatment on the individual surface regions of the particles of bulk material.

More particularly, but not exclusively it aims at accelerating the drying of pasta, the acceleration being achieved at pre-drying and/or final drying or only in individual steps or stages of pre-drying and/or final drying.

A further object of the invention is to provide a method which makes it possible to heat particles of bulk material, notably including pasta, rapidly to a specific temperature with with high microwave energy and without local burning.

SUMMARY OF THE INVENTION

Surprisingly it has now been found that contrary to the treatment theories usually held in the art hitherto, the intensity of drying in the case of pasta can be greatly increased without harm if, according to the invention, the individual particles or pieces of bulk material are turned and displaced relatively to one another during treatment.

According to the use proposed by the present invention, it is provided that the pasta pieces are kept freely in motion in the drying air relatively to one another and relatively to the air flow, preferably with formation of a throughflow fluidised bed.

In contrast to the stationary treatment employed hitherto, the use of which in pre-drying has been accepted almost as a dogma, even with a first test apparatus it was found that moving treatment made possible an unexpected improvement as regards intensity and correspondingly as regards the dimensions of the installation. Preferably the pre-drying includes at least one treatment stage, of which at least one, namely the first treatment stage, takes place in a fluidised bed. Thus when drying pasta it is possible to dispense with the shaker pre-dryer i.e. the crust formation on the outer surface practised hitherto, thus providing better conditions for the drying work as a whole.

If the first stage of the pre-dryer operates with a throughflow fluidised bed, the mechanical stressing of the pasta pieces is so slight that their shapes are retained even without prior surface crusting. In other words, the freshly pressed pasta article has sufficient strength for subsequent drying.

Surprisingly, the throughflow fluidised bed which has been used in almost all branches of industry for decades has been found to be the best solution.

By a throughflow fluidised bed there is meant not simply blowing through a bed of material. In the technical world "fluidised bed" denotes a state of affairs wherein the air forces are approximately as great as or greater than the gravitational forces acting on the particles of bulk material. According to the present invention the individual pieces must be turned and displaced relatively to one another. But displacement requires per se much greater forces as compared with the pieces being moved along in a stationary condition so to speak in known dryers. The essence is that the air forces act almost on the entire surface in contrast to all mechanically effective forces, which mostly act on local points at only small surface areas. In a fluidised bed, the apparently powerfully acting forces in fact subject a pasta piece to less stress than would be the case with the action of a mechanical force. It is assumed that the continual movement and all-round action on the pasta pieces during treatment, or drying, are capable of reducing and cancelling local stresses. At any rate after even a few experimental runs of a test apparatus neither deformation nor stressing or corresponding cracking of the pasta pieces could be observed.

When drying pasta it is found that all fixed bed processes used up to the present day for the drying of pasta allowed no great increase in the drying effect, since the bed is rearranged only a few times during the entire drying time from belt to belt, in intensive drying, to permit the drying air to act evenly on all surface regions of the pasta pieces.

Usually it is not sufficient in the fluidised bed to select the air speed to be so great that the individual pieces are kept in suspension without further provision being made to ensure bed re-arrangement.

Even when the air quantity is increased slightly further for example to the state wherein the product presents an image like slightly boiling water, in many cases not quite satisfactory results have been obtained for industrial production.

Only the realisation that each piece should be kept in motion in free manner both relatively to the other pieces and also relatively to the air flow, and the pasta should be subjected to continuous bed re-arrangement, affords the surprising advantage that much more powerful drying conditions can be amployed. The temperature and the moisture difference between air and pasta can be substantially above the conventional values, without special measures such as intermediate cooling and so forth being needed.

With the new method it is useful if the bed re-arrangement takes place during the whole drying time at short intervals both in the vertical and in the horizontal directions.

Pasta situated below has to move upwards systematically, pieces at the sides into the middle and vice versa.

The throughflow fluidised bed thus allows, with adequate statistical certainty, giving each individual pasta piece of the entirely the same conditions.

Small differences in the size of the pasta pieces are unavoidable in production. But it was possible to make the interesting observation that no separating effect was caused, and no corresponding unequal drying. Freshly moulded thin-walled pasta such as conical and purse-shaped shells etc. did not have their shape spoiled by the strong movement in the bed. Despite the more severe drying action, the dried pasta do not exhibit any cracks, so that it has been possible to eliminate all initial doubts regarding the use of the throughflow fluidised bed.

On the contrary, the good results lead one to assume that the fluidised bed affords ideal conditions for uniform drying of each individual piece, and for keeping mechanical stresses to a level which does not harm the pieces. The pieces do not rest on the support, but are carried and moved as if by an air cushion. There are no flattened contact areas or depressions caused by impacts, such as would occur if the drying rate were increased excessively in the known methods.

The best conditions for the new method are afforded if the throughflow speed of the drying air in the fluidised bed is chosen to be between a lower value only slightly below, but preferably somewhat higher than, the loosening point, and an upper value lower than the discharge point of the pasta being treated.

With a throughflow speed slightly below the loosening point, the pasta pieces are in a labile state, so that loosening can be initiated for example with mechanically moved aids almost without the exertion of force or pressure, and bed re-arrangement and free movement of the pieces relatively to one another and relatively to the air flow are achieved. This solution may be advantageous in the case of pasta pieces of simple shape.

It is also feasible with relatively high throughflow speeds for the drying air in the fluidised bed, in the range below the discharge point, to achieve very good regularity in movement, bed re-arrangement and thus drying, in many cases without further measures being needed. The air speed measured over the fluidised bed can be about 3–6 m/sec (meters per second) in the case of pasta pieces in the form of conical shells of 1–2cm in length.

In the pasta industry it is normally desirable for all forms of short products to be produced on the same pasta product line.

It has been found that this particular object can be achieved in that the movement of the pieces relatively to one another and relatively to the air flow and also continuous bed re-arrangement are enforced by the pulsating flow of the drying air.

This solution makes it possible without having mechanically moved parts in the throughflow fluidised bed to use all the advantages of a fluidised bed, which are known to be quite especially great in the case of drying, and all short products formed in the conventional shapes can be dried.

It is even possible for relatively short noodles to be dried in the manner proposed by the present invention. However, the air speed must be set in the region below the discharge point.

With pulsating air there is no need for the equalising devices for the air distribution which are normally used in fluidised beds, or at least they can be reduced to a minimum.

But the greatest advantage of pulsating air flow in the drying of short products is that the movement and bed re-arrangement of the pieces is carried out in the optimum manner and yet with low air speeds.

In very many cases it would be possible to fix the speed in the region of the loosening point. But in order to eliminate any external disturbing influences the air speed is normally to be so selected that it is slightly above the loosening point. The values are between 1–5 m/sec, in the commonest uses between 1.5 and 4 m/sec, depending on the form of the pasta.

In known methods a sharp initial drying stage is often provided, removing a large quantity of water in a short time with considerable temperature and moisture differences.

To make it possible to prevent cracks forming in the external layer of the pasta pieces, and other disadvantages, however, often a so-called sweating phase is interposed, this being essentially an interruption in the drying operation, for the purpose of adjusting the moisture to the temperature and stresses in the pasta pieces.

It seems that when using a throughflow fluidised bed this is necessary only in exceptional cases, since as a rule each surface region is subjected to the action of drying air uniformly by the constant motion, so that internal stresses are avoided.

The greatest problem in final drying, on the other hand, lies in the drying itself and not in making the pieces keep their shape.

As the material being dried becomes increasingly warmer, the moisture moves more quickly to the external surface of the pieces. Also, the migration of heat in the pieces proceeds more quickly than the migration of moisture.

It would seem obvious just in the final drying of pasta pieces to hasten the drying operation by heating the product quickly and thus driving the water more quickly to the surface of the piece. But this has the result that the pasta pieces may become soft and sticky again, and in the state of the art the subsequent drying would have to be carried out in only a single layer as in the pre-drying stage. So the advantages and disadvantages would cancel one another out.

This is also why all hitherto advanced proposals or hitherto known attempts aimed at intensive final drying have been unsuccessful.

According to an advantageous use of the method, during heating the individual particles of material are to be displaced and turned relatively to one another.

In order to allow shorter drying times to be obtained, especially in the final drying, it has been found very advantageous following the heating in a fluidised bed to turn and displace the individual pieces of material relatively to one another in the drying air flow in the drying operation also. In this way the invention can be made double use of.

Maximum results can be obtained if in the final drying operation the heating and drying just described with the simultaneous displacement and turning of the individual pieces relatively to one another is carried out twice i.e. in two stages following one another.

In a preferred application of the method it is proposed that in the final drying the treatment stages are subdivided into two steps, and that the material is heated with microwaves in the first step. Preferably the air can be guided in pulsatory manner through the material at least where the fluidised bed is subjected to the action of microwaves.

The relative movement of the pieces with respect to one another and their turning movement on the one hand, and the changing spacing of the pieces with respect to one another caused by the pulsation on the other hand have the effect that the pieces in the direction of the greatest electrical field strength keep forming new chain-like structures with varying pieces and varying contact points. This allows rapid conversion of high microwave energy into heat, without the occurrence of local burning.

It has also been found that heating with microwaves allows a shortening of the final drying which has not been considered possible hitherto.

By virtue of what has been said hereinbefore, it follows that the highest drying rates can be achieved when the method according to the invention is used both in pre-drying and also in final drying, and in addition a heating operation with microwaves is carried out once or twice in the final drying.

BRIEF DESCRIPTION OF THE DRAWINGS

The invention will be explained by way of example with the help of the accompanying diagrammatic drawings wherein:

FIG. 5 shows a section along the line V—V in FIG. 4, FIG. 6 shows a section taken along the line VI—VI in FIG. 4.

In FIG. 1 the pasta press 1 is shown only in schematic manner. A moulding head 2 is shown in the upper centre of the illustration, associated with a cutting device 3 with cutters 4 and driving motor 5.

Figure 1:
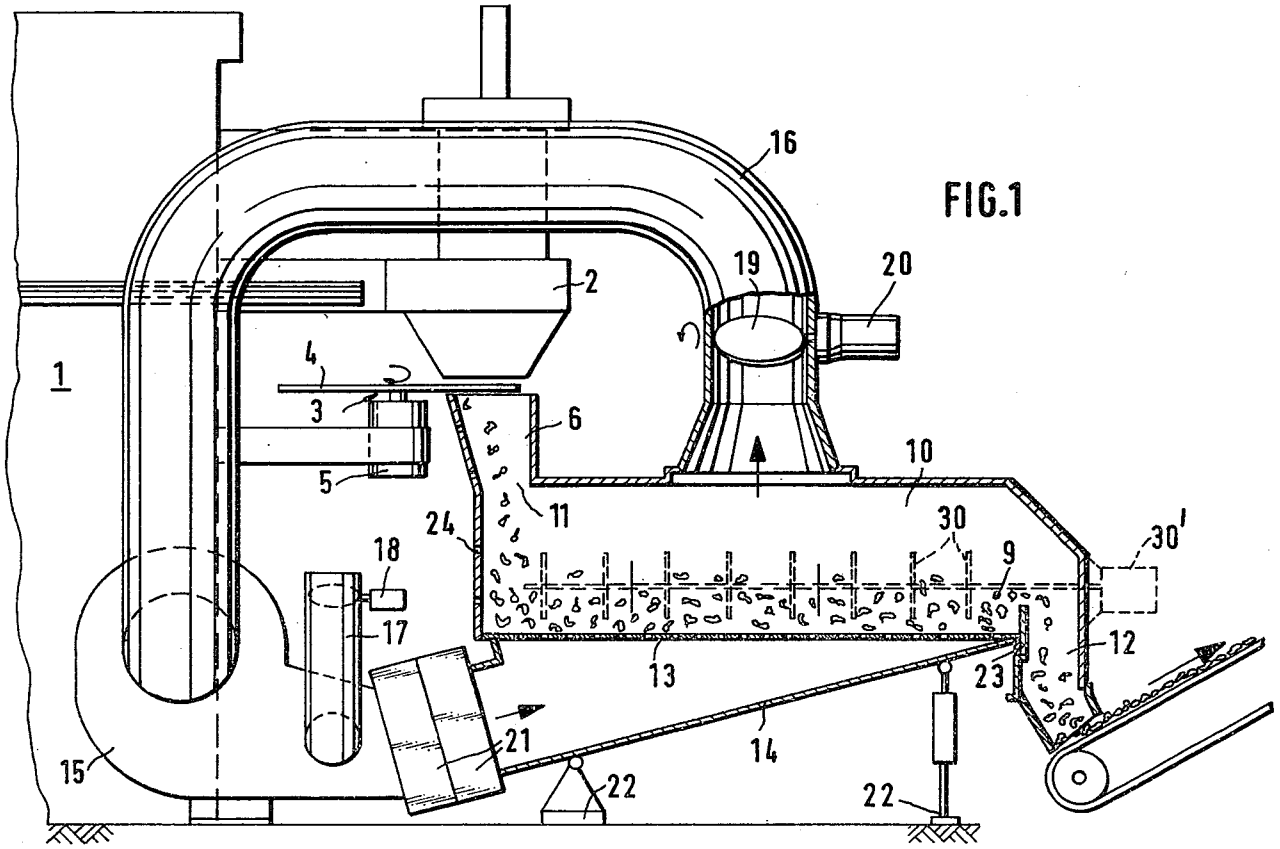
FIG. 1 shows a first constructional example of a treatment duct in the form of a fluidised bed duct.

A transition piece 6 constitutes the connection with a treatment duct constructed as a fluidised bed duct 10, in the manner of a housing closed all round except for an inlet aperture 11 and an outlet aperture 12. The fluidised bed duct 10 comprises, below, a porous floor 13 in the region of which an air supply conduit 14 opens. A fan 15 provides the necessary air throughflow and is connected at the suction side again with an air discharge conduit 16 to the duct 10. The zero pressure point can be set in the air system with an air outlet 17 which has a regulating valve 18. Preferably a slight negative pressure is maintained in the fluidised bed duct 10.

The air quantity can be adjusted in known manner by speed varying means associated with the fan 15.

In the air discharge conduit there is provided a pulsation valve 19 which is given oscillatory or rotary movement by the motor 20 and thus pulses the air in the duct 10, and a frequency of even a few impulses per second gives good results.

Arranged between fan 15 and fluidised bed duct 10 are conditioning means 21 which comprise the known heat exchanger and also moisture supplying and discharging means, for producing the desired air temperature and air moisture in the air entering the fluidised bed.

In order not to transmit any mechanical vibrations of the system to parts of the building, the unit formed of the fluidised bed duct 10 with all ancillary equipment is mounted on special supports 22.

Arranged before the outlet aperture 12 is a level regulating slide 23 for the fluidised bed, and this slide can be provided with suitable movement and if necessary monitoring and control means depending on the desired degree of automation. In the transition piece 6 and in part in the upright wall parts of the fluidised bed duct 10 bores 24 are provided for the introduction of air to prevent sticking at these regions.

Figure 2:
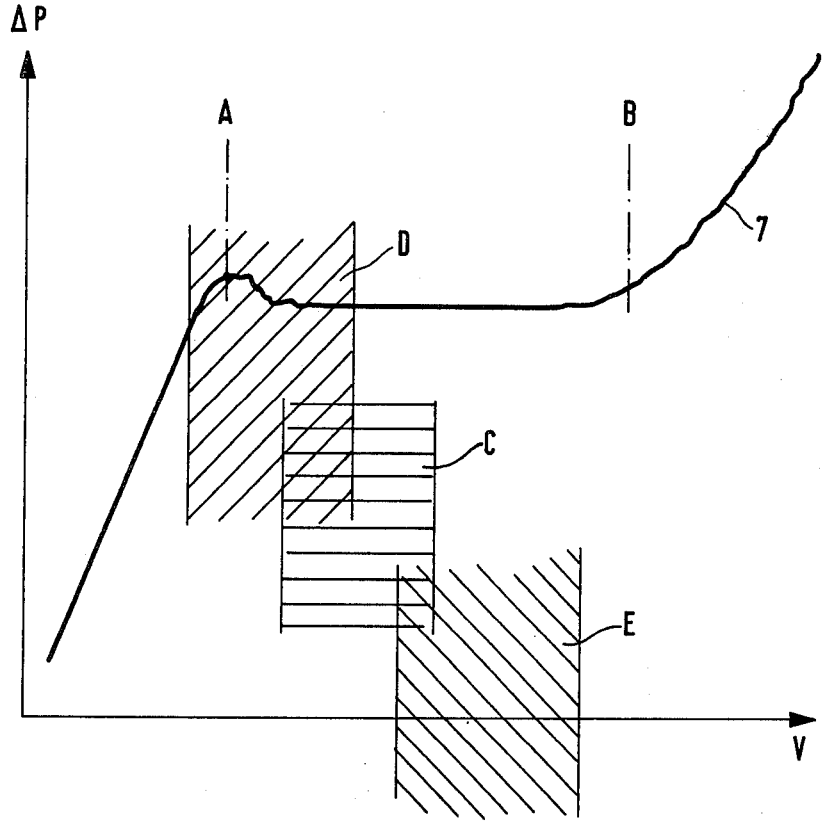
FIG. 2 shows a graph illustrating the known connection between air speed and pressure pattern in a fluidised bed.

The operation of the illustrated apparatus is in accordance with the method of the invention described above the air speed when the pulsation valve is used being set preferably in zone C (FIG. 2).

As a constructional variant there is arranged in the fluidised bed duct 10 a mechanical bed re-arrangement device 30 which is set in motion by means of a drive unit 30', this device being shown in dot-dash lines. In this construction the zone D (FIG. 2) will be chosen in most cases for choice of air speed.

The pressure-speed curve 33 in FIG. 2 must be ascertained for each individual product in accordance with known methods. In the graph pressure loss $\Delta$ P across the material bed (measured along the $y$-axis/ordinate) is plotted against dry air speed V (measured along the $x$-axis/abscissa). The loosening point A is often difficult to determine. More particularly freshly moulded parts present some problems owing to the tendency to stick together. But as a rule average values are sufficient, determined for example from semi-dried pasta.

Normally the loosening point can be ascertained visually in a transparent measuring device by a sudden growth in the material bed. This is the change from a fixed bed to a loose fluidised bed.

The discharge point can also be determined visually, fixing the values obtaining when there is the first carrying-away of relatively small pieces.

Represented graphically, there is always a similar pattern of pressure-speed curve roughly corresponding to the curve 33 in FIG. 2.

Figure 3:
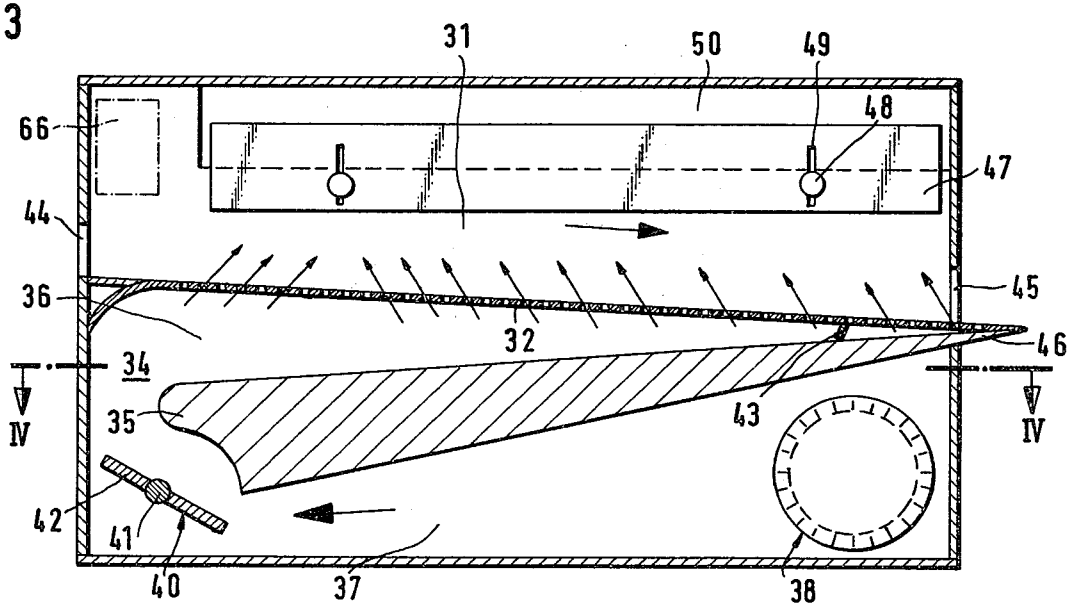
FIG. 3 shows a vertical longitudinal section through a second constructional example of a treatment duct in the form of a fluidised bed duct, along the line III—III in FIG. 4, parts being omitted for clarity.
Figure 4:
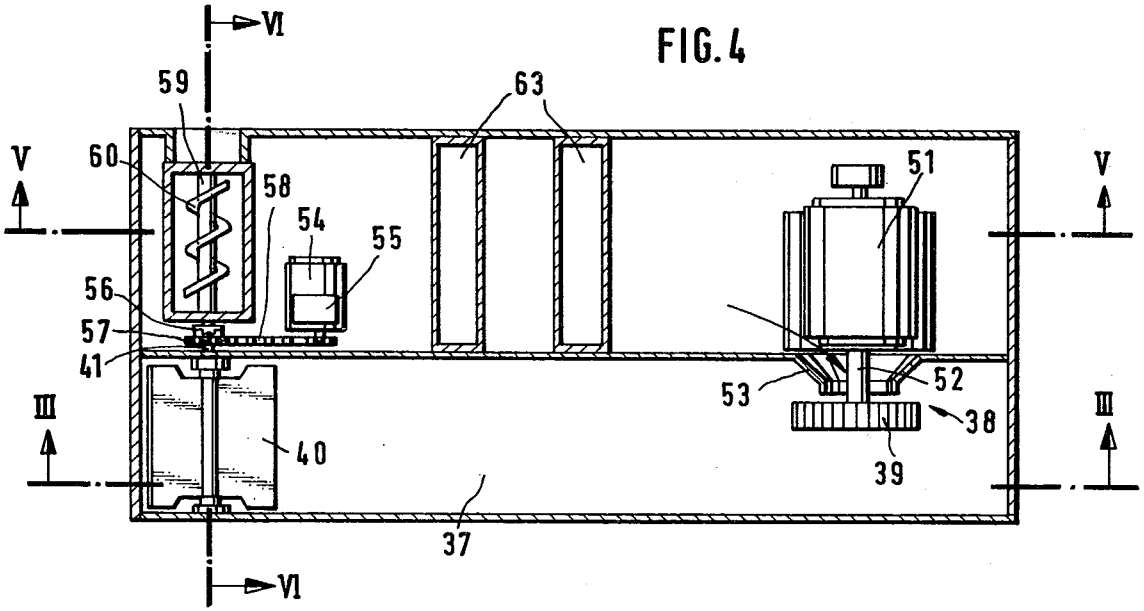
FIG 4 shows a section taken along the line IV—IV of FIG. 3.

The example shown in FIG. 3 comprises a fluidised bed duct 31 with a porous floor 32 which consists of a perforated plate. Below the perforated floor 32 there is a pressure chamber 34 which is divided by a diagonally situated intermediate wall 35 into an upper pressure chamber 36 and a lower pressure chamber 37. In the lower pressure chamber 37 a blown air generator 38 is situated in the region of the largest cross-section. The blown air generator 38 has a fan impeller 39 without a spiral housing. The lower pressure chamber 37 itself forms the fan housing. An air pulsator 40 is mounted on a shaft 41 and comprises, as FIG. 3 and FIG. 4 show, a pair of pulsator blades 42. At the end of the upper pressure chamber 36 an air valve 43 is provided for regulating the air quantity in the last section of the fluidised bed duct. The air pulsator 40 is arranged at the narrowest point of the lower pressure chamber 37. Because of the narrowing form of the lower pressure chamber 37 from the blown air generator 38 to the air pulsator 40, the air pulsations have only very little reaction effect on the blown air generator. The upper pressure chamber 36 is also given a narrowing form in the direction of the air-pervious floor 32.

The fluidised bed duct 31 comprises at the left an inlet aperture 44 and at the right an outlet aperture 45 for the material being dried. The porous floor 32 has at the outlet aperture 45 an extension piece 46 which is provided as a transition to the next apparatus. In the upper part of the fluidised bed duct 31 there is arranged an adjustable air throttle device 47 which moves upwards and downwards in the manner of a slide after release of holding grippers 48 in the region of longitudinal slots 49, so that the cross-section of the throughflow aperture 50 can be adjusted.

In the lower half of FIG. 4 there is a horizontal section through the lower pressure chamber 37. The blown air generator 38 is shown schematically, this comprising a driving motor 51, the fan impeller 39, the said impeller being mounted on a shaft 52, and an air suction union 53.

The air pulsator is directly driven by a motor 54 which is preferably provided with a change-speed gear 55, through the agency of a clutch 56. Secured to the shaft 41 is a toothed wheel 57 which by means of a chain 58 drives a worm shaft 59 with a conveying worm or screw 60.

FIG. 5 shows a general view of the air circulation duct in a longitudinal section, the motor 54 and the conveying worm 60 being again shown at the lower left. Arranged over the conveyor worm 60 is an air filter 61. The air filter 61 retains pasta pieces which are carried along into the air duct through the aperture 50. The pieces fall downwards in the air filter 61 and are pushed out by the conveyor worm 60 through a flap 62 shown in FIG. 6. The flap 62 is opened only when sufficient product is present and pressure is applied to the flap thereby. In this way uncontrolled entry of outside air into the air duct at this region can be prevented.

In FIGS. 4 and 5 air conditioning means 63 in the form of heat exchangers are also situated in the air duct directly before the blown air generator 38. Both the air filter 61 and also the air conditioning means 63 have a stilling effect on the air flow, so that the pulsations are damped sufficiently strongly so as not to result in anything detrimental to housing parts or to the air flow generator 38.

FIG. 5 also shows a fresh air filter 64 at the left upper region, through which all the fresh air is drawn in. In order to allow regulation of the fresh air quantity, a fresh air valve 65 upstream of the filter is adjusted in accordance with requirements.

The surplus air is discharged through a union 66 (FIGS. 3 and 6. The air quantity can also be regulated precisely at union 66 by a regulating valve 67.

The drawings do not show all the control and regulating devices, for the sake of simplification. There would be more particularly measuring sensors for air temperature, for air moisture, the necessary control, converting and regulating units therefor, and also for all flaps, valves, motors and for conditioning means.

In FIG. 6, in the left-hand half, the air circulation duct with air filter and the conveyor worm 60 are shown in cross-section, and in the right-hand half the fluidised bed duct 31 and the upper pressure chamber 36, with the air pulsator 40. The fluidised bed duct 31 and the upper pressure chamber 36 are separated by the porous floor 32.

The apparatus operates as follows.

The blown air generator 38 and the air pulsator 40 are switched on, likewise all control and regulating units, and the circulating air is brought to the requisite temperature and moisture with the use of the conditioning means. The pasta press is started so that fresh pasta pieces start to be fed into the fluidised bed duct 31 through the inlet aperture 44. The fresh pasta pieces thus pass from the press directly into the pre-dryer. Pre-solidification does not occur. In the example shown in FIG. 3 the floor 32 comprises, directly following the inlet aperture 20, a first relatively short section with holes directed obliquely upwards in the product conveying direction, as shown by obliquely upwardly directed arrows.

The pasta pieces are given in that short section a strong impulse in the conveying direction from left to right in the illustration. On the remaining portion of the floor the holes in the floor 32 are directed oppositely to the product conveying direction. This measure achieves two objects. Firstly it assists the tendency for air especially to be drawn in through the outlet aperture 45 and through the inlet aperture 44, and secondly a strong whirling effect is produced by the two oppositely directed flows from the first section to the second, and thus the risk of moist pasta pieces sticking together is completely eliminated. The flow directed oppositely to the direction of product conveyance inhibits the product flow and helps to maintain a desired bed thickness and a desired time of dwell for the pasta in the fluidised bed.

The further factors influencing the time of dwell and thus connected with the drying time include the quantity of pasta processed per hour, the air quantity and the angle of inclination of the fluidised bed.

Usually the hourly output of pasta to be processed is given by the preceding machines, or follows from a desired daily output. Changing the angle of inclination of the fluidised bed is inconvenient as regards handling, and complicated as regards constructional arrangements since the floor 32 has to be sealed relatively to the upper pressure chamber 36.

For regulating the time of dwell preferably the air speed in general is increased or reduced, and the air quantity in the last section of the duct 31 is adjusted with an air valve 43. If less air is blown in in the last section of the fluidised bed duct 31, the product flow at this region is inhibited, giving an actual damming-up effect. The bed height can be varied within wide limits with the air valve 43 without mechanical parts — valves and the like — in the product flow itself. In this constructional example the fluidised bed is divided into three sections, a first bubbling zone, an actual fluidised layer and a damming zone. Thus the time of residence of the pasta pieces and all the conditions in the bed can be deliberately regulated, and even pasta shapes regarded as difficult to process, such as thin-walled purse shell shapes and the like, can be produced with better utilisation of energy than hitherto, and to the highest quality standard.

The more intensive drying operation provided by the new method permits the construction of a very compact drying installation. The use of the method in the field of pre-drying alone results in shortening the drying installation to the extent of 10–15 m, so that the manufacturing costs for pasta products can be considerably reduced.

Such intensive drying can be achieved in the pre-drying operation that it is already sufficient to have a time of dwell of a few minutes to achieve very good economic results with bed heights of 5–10 cm and less for the fluidised bed.

For industrial use of the apparatus for continuous drying it was necessary to arrange the fluidised bed duct 31, the parts for introducing and discharging air, the air conditioning means 63, the blown air generator 38 and the air pulsator 40 in a casing forming a self-contained unit, as described. The casing had to be insulated. The main problem was that whilst keeping production costs low it was necessary to take specific requirements into account, more particularly as regards moisture, oscillation, and noise problems. For reasons of expense it was desirable that the wall parts of the casing should at the same time form a supporting structure and an external boundary of the individual spaces or chambers.

Figure 7:
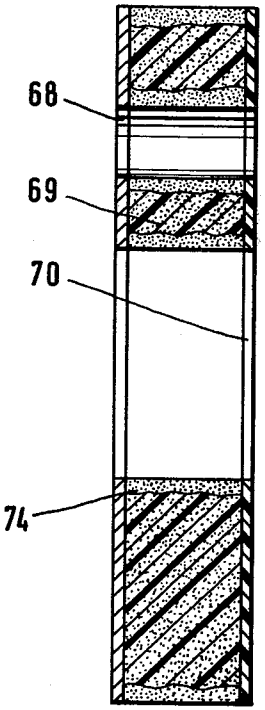
FIG. 7 shows a section through a wall element of the casing containing the fluidised bed duct according to FIG. 3 taken along the line VII—VII in FIG. 8.
Figure 8:
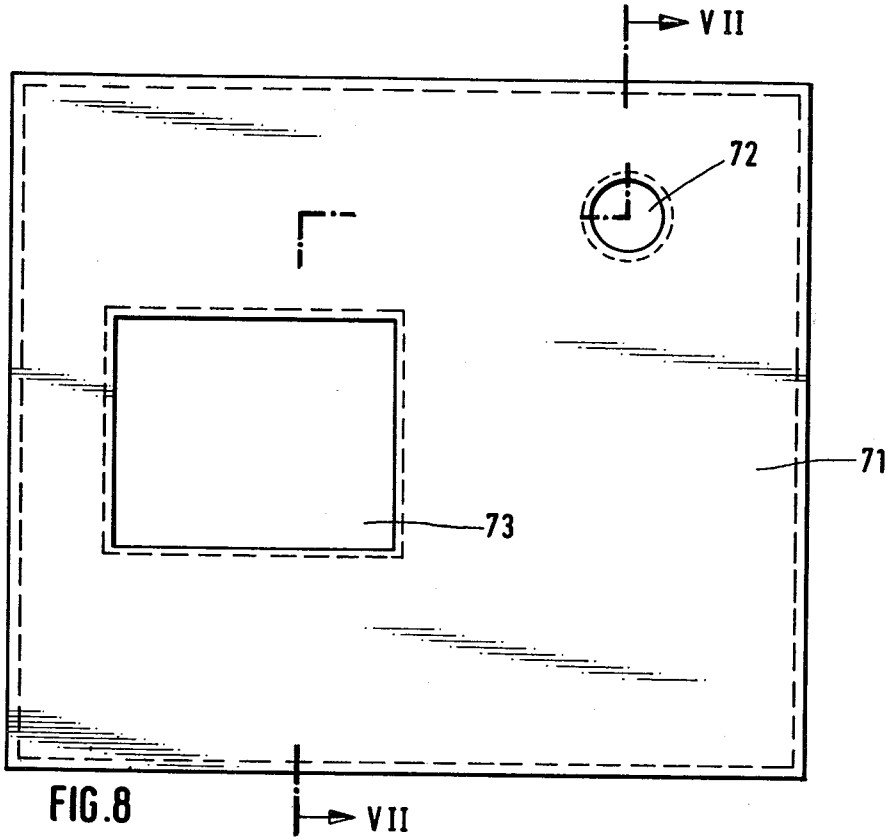
FIG. 8 shows a view of the wall element.

It has now been found, as shown in FIGS. 7 and 8, that a three-layer composite structure comprising an aluminium plate 68, a foam plastics panel 69 and a plastics material panel 70 or the like as outermost layer meets all requirements most satisfactorily. The three parts are adhesively secured to one another to form flat panels 71. All apertures 72, 73 are formed, and at all apertures, end faces etc. at which the foam plastics panel 69 is visible, the latter is cut back a little and these places are filled again, and thus sealed, with a spreadable substance 74.

The aluminium plate 68, which is directed inwards, and in part comes into contact with the pasta, meets hygienic requirements and at the same time forms a complete vapour barrier. The same also applies to a limited extent to the external plastics material panel.

The entire composite structure can stand up to air pressure sufficiently well even as a body with a large surface area, so that no deformation occurs in use as a result of vibrations.

Doors and wall parts can be produced in the same way.

Figures 9, 10:
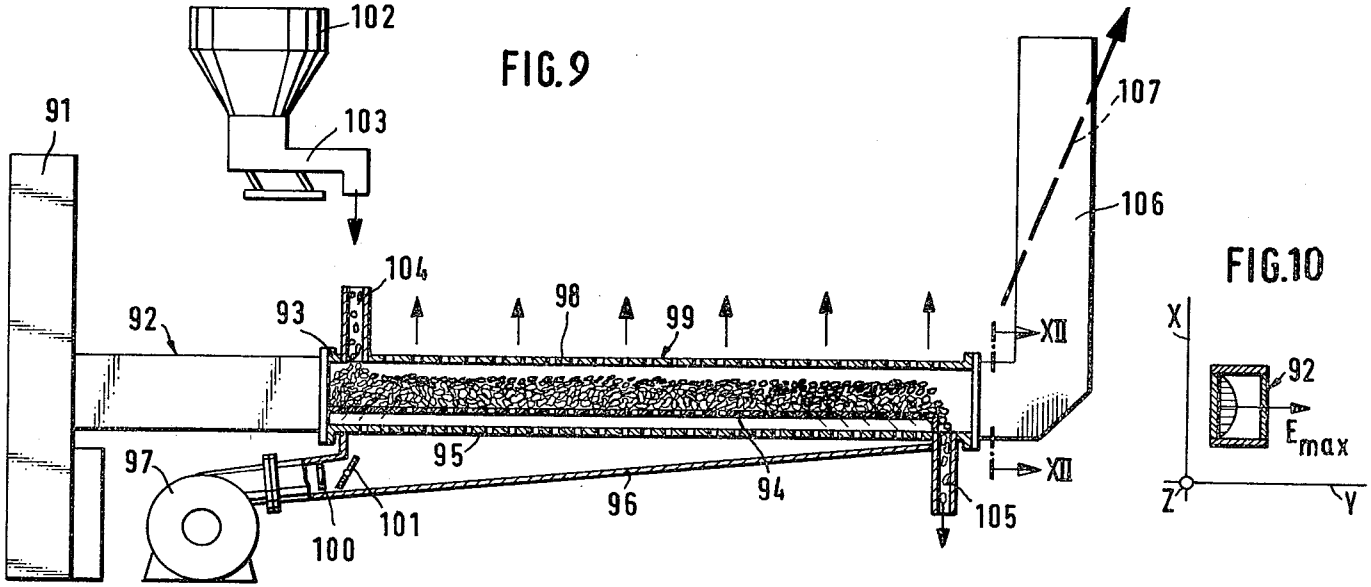
FIG. 9 shows a vertical longitudinal section through a fourth constructional example of a treatment duct in the form of a fluidised bed duct with a microwave heating device.
FIG. 10 shows a section along the line XII—XII of FIG. 9.

In the constructional example shown in FIG. 9, the reference numeral 91 designates a microwave generator which is connected to a waveguide tube 92 of rectangular cross-section (FIG. 10). The part 93 of the waveguide tube 92 forms the treatment duct 99 in which the bulk material e.g. pasta is heated. The treatment duct is constructed as a fluidised bed duct. The microwave generator 91 can be designed for example for an electrical power of 25 Kw with a frequency of 915 MHz. The waveguide tube 92 has a rectangular cross section, the dimensions of which are adapted to the working frequency and in the present case amount to 150 × 250 mm with a frequency of 915 MHz. The narrow-side walls in the section 93 of the waveguide tube 92 are perforated and gas-pervious, and the microwaves do not radiate outwards because of their particular behaviour in a waveguide tube. Slightly below the longitudinal centre axis of the section 93 a porous floor 94 is arranged at least approximately horizontally. Terminating at the perforated wall 95 of the waveguide tube 92 is an air supply conduit 96 which is connected to a blown air generator 97. The air discharged by the blown air generator 97 passes through the wall 95 of the waveguide tube section 93, the porous floor 94 and then the material for treatment lying thereon, whereupon said air issues from the section 93 through the narrow wall 98. The porous floor 94 consists of a material with particularly low dielectric losses. Between the wall 95 and the blown air generator 97 there is provided an air pulsator 100 e.g. a rotating throttle valve which chops the air current so that the flow of air is supplied in pulsatory form to the porous floor 94. A throttle valve 101 is also arranged in the air supply conduit 96 to regulate the air pressure and the air quantity. The bulk material to be treated is passed from a feed hopper 102 by way of a vibrating feeder 103 to an inlet aperture 104 which is constructed as an UHF lock. The supply of bulk material can be regulated with the vibrating feeder 103. The bulk material passes through the inlet aperture 104 on to the porous floor 94. The blown air coming from the blown air generator 97 is to be given such a speed that the bulk material situated on the porous floor is put into a suspended state. The pulsatory supply of blown air produces a uniformly thick fluidised bed and the individual particles are moved up and down in the vertical direction in a suspended state. In this suspended state the bulk material behaves like a liquid on the porous floor 94, so that it flows from there through an outlet aperture 105 with an UHF lock. The microwaves not taken up by the bulk material are removed in the end section 106 of the waveguide tube 92 by a water trap 107. On the porous floor 94 the bulk material flows in the direction of one space axis (*z*-axis). In the pulsatory fluidised bed each individual particle also has movement imparted to it in the direction of a further space axis (*x*-axis), and displacement in the direction of the third space axis (*y*-axis) and also rotational movement in a direction about one at least of the three axes is promoted.

Since the porous floor 94 is situated slightly below the longitudinal centre of the waveguide tube 92, the bulk material moves in the form of a fluidised bed with its centre in the region of greatest electrical field intensity (FIG. 10). The fluidised bed situated on the porous floor 94 is statistically of a uniform density and thus constitutes a constant impedance, which does not result in any sudden energy flexion peaks. Accordingly the pieces are heated in uniform manner, so that the microwave energy and the period of dwell can be satisfactorily regulated. The air speed can be regulated with the throttle valve 101. With higher air speed the thickness of the fluidised bed on the porous floor 94 increases, and its density decreases correspondingly. Consequently the take-up of energy by the bulk material can be influenced by the air speed. In this example, although the blown air plays a subordinate role it serves not only to form the fluidised bed but also to discharge the moisture from the bulk material and for heat equalisation within the bed.

The blown air required for forming the fluidised bed can be further used in a general plant for improving efficiency if it is conducted to preceding or following drying stages in the air circulation process.

Figure 11:
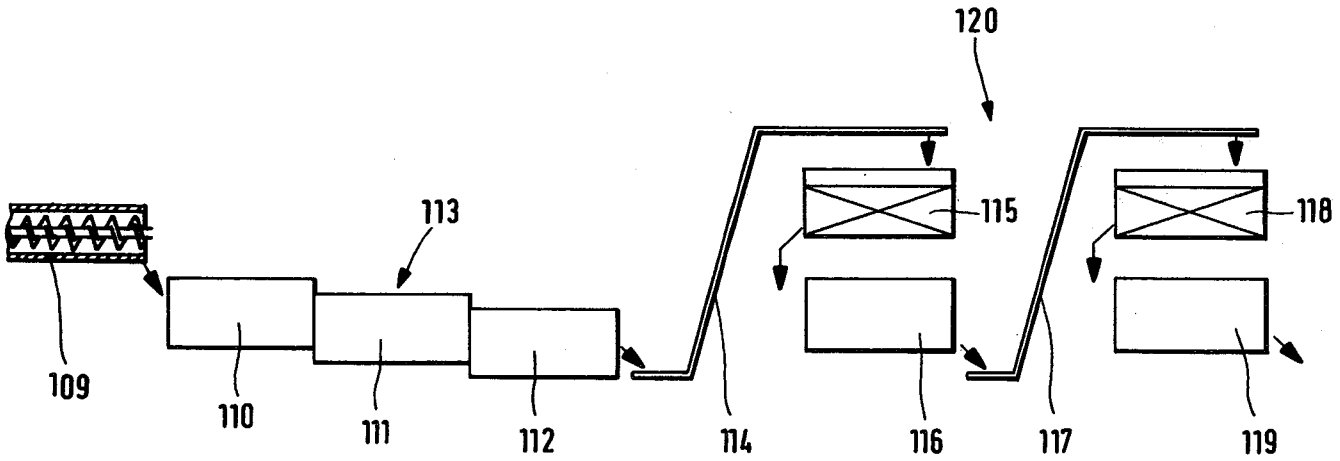
FIG. 11 shows a view in diagrammatic manner of a first example of a complete pasta drying installation.

FIG. 11 shows a general drying installation. From a moulding screw 109 the freshly pressed or moulded pasta pieces are introduced directly into a pre-dryer 113 comprising three drying units 110, 111 and 112. A unit of this kind has been described with reference to FIGS. 3 to 6. And the drying units 110, 111 and 112 can be constructed thus. Each such drying unit 110, 111 and 112 forms a treatment stage. As is known, initially the drying operation is very quick, but is slowed down to the extent that the moisture content of the substance being dried decreases. As was ascertained with a first experimental plant, it is possible in the pre-dryer 113 with the three drying units 110, 111, 112, with average press outputs of 500 kilograms per hour of pasta containing 30 to 32 percent of water by weight to remove water to the extent of 10 to 15 percent by weight. In every drying unit 110, 111, 112 the fluidised bed covers an area only of approximately one square meter. With three such drying units it is possible in a conventional drying installation to replace the pre-dryer, the shaker pre-dryer and the first part of the final dryer.

From the drying unit 112 of the pre-dryer 113 forming the third stage the pasta pieces are fed by a conveyor 114 to a final dryer 120. In the final dryer 120 the pasta pieces are finish dried in two stages 115, 116 and 118, 119 respectively interconnected by a conveyor 117. The two stages 115, 116 and 118, 119 are sub-divided into two treatment steps. The first treatment step takes place in a heating device 115. Substantially the water is expelled from the interior of the individual pieces to the surface thereof. In the subsequent step the water is dissipated from the surface of the pasta pieces in a drying unit 116 by means of blown air. The third step again takes place in a heating device 118. The water is again driven from the interior of the pasta pieces to their surface. In the following fourth step in the drying unit 119 the water is again removed by blown air from the surface of the pasta pieces. A preferred form of embodiment of the heating devices 115 and 118 is described with reference to FIGS. 9 and 10. The drying units 116 and 119 can be constructed identically to those 110, 111 and 112 of the pre-dryer 113. A preferred form of embodiment of these drying units 116 and 119 is described in connection with FIGS. 3 to 6. In both stages of the final dryer 120 the heating devices 115 and 118 are connected with the associated drying units 116 and 119 preferably in the way described in connection with FIGS. 12 and 13.

In the units 116 and 119 the pasta pieces are dried to 14 and 12% respectively in the example mentioned. The intermediate heating is intended primarily to bring the pasta pieces to a uniform high temperature over the entire cross-section, so that the transporting of liquid to the surface of the pasta pieces is promoted and hastened, and drying in the final drying operation also can be intensified.

Although in the final drying the constant restratification and the movement of the individual pasta pieces relatively to one another and relatively to the air flow is less important that in pre-drying, it has been found that in this way the overall economic aspect of the plant can be improved, since the drying and the entire enegry transmission can be increased to the highest levels.

With less tricky products it is in principle possible to carry out the entire drying operation in a coherent fluidised bed, but of course in that case it is advantageous to provide different zones for air throughput and for air conditioning.

It is also quite feasible for example to carry out pre-drying and final drying each in a separate fluidised bed.

The two last-mentioned constructional forms, however, have the disadvantage that each plant must be made to size, and later alterations are very expensive. In spite of an apparently greater outlay for the drying of pasta it has been found to be the most advantageous solution to construct the entire drying line of a relatively larger number of basic units. This has the advantage that the arrangements of the units for example can be adapted to the dimensions of the building, since the units can be placed one behind the other, or a plurality of units one above the other.

Since in known presses for short products two moulding heads are often used, arranged at a spacing of about 1m, the solution with the units makes it possible by arranging two lines adjacent one another in the smallest possible space to double the drying capacity.

Figure 12:
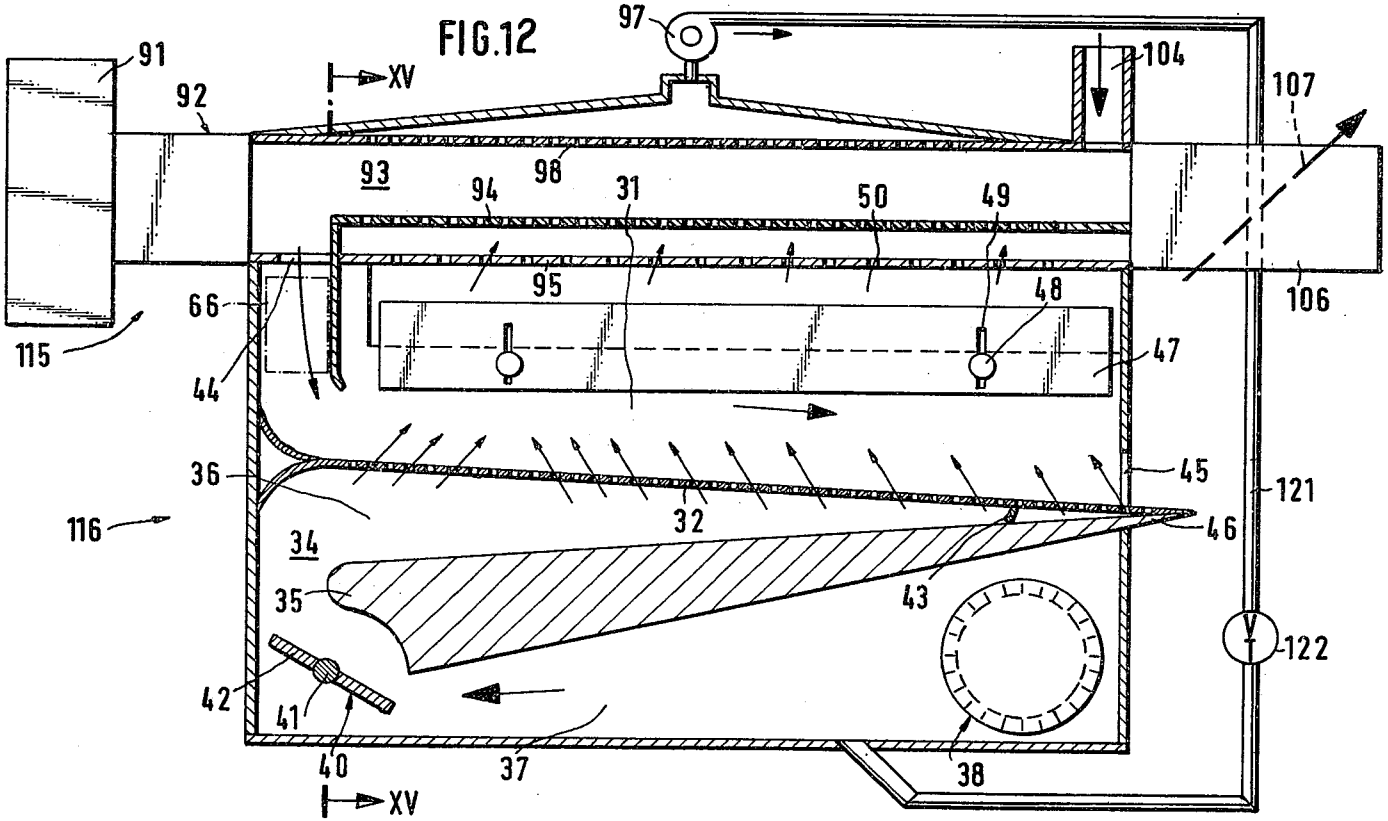
FIG. 12 shows an example of two treatment ducts in the form of fluidised bed ducts for carrying out two successive method stages, the upper treatment duct of the preceding method stage having a microwave heating device.
Figure 13:
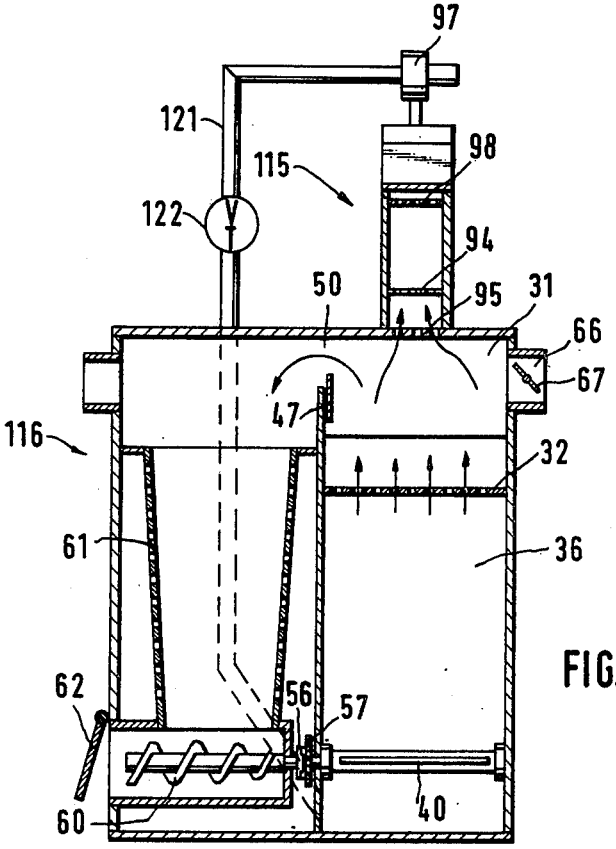
FIG. 13 shows a section along the line XV—XV of FIG. 12.

FIGS. 12 and 13 show in detail a possible construction of the two stages 115, 116 and 118, 119 of the final dryer 120. The description will be given with reference to the first stage 115, 116.

The first step in the first stage 115, 116 is carried out in a heating device 115, as described substantially in FIGS. 9 and 10. The second step in the first stage 115, 116 is carried out in a drying unit 116 as described in FIGS. 3 to 6. In FIGS. 3 to 6, 9, 10, 12 and 13, therefore, like reference numerals designate like or equivalent parts. Therefore, repetitive description of details will be avoided.

The heating device 115 is placed over the fluidised bed duct 31 on the drying unit 116. The lower porous floor 95 is integrated into the upper cover plate of the drying unit 116, so that the treatment air from the fluidised bed duct 31 can pass through the perforated wall 95 into the heating device 115. The blown air generator 97 draws the blowing air from the fluidised bed duct 31 through the porous wall 95, the porous floor 94 and the likewise porous wall 98 and takes it back through the conduit 121 into the pressure chamber 34 of the drying unit 116 situated therebelow. By means of a throttle element 122 and the air throttle 47 on the one hand it is possible to determine the quantity of air which is circulated in the heating device 115 and in the drying unit 116 together, and on the other hand is circulated only within the drying unit 116. The heat of the blown air warmed in the heating device 115 is used again in the drying unit 116, allowing an extremely economical energy utilisation. In a constructional example not shown it is also possible to provide a blown air circulation between a plurality of successive stages if this seems appropriate for improving the economic aspects.

The construction of the individual stages of the final dryer 120 shown in FIGS. 12 and 13 shows that it can be produced in an extremely compact, space-saving form.

The constructional example shown in FIGS. 12 and 13 is particularly suitable for all kinds of intensive heat treatment. Thus it has been found that it can be used to very good advantage for drying and/or roasting products such as cocoa beans, nibs, coffee and nuts of various kinds such as ground nuts and hazelnuts. As a first step the product can be heated to just the desired temperature and the following step, be it drying or roasting, then takes place under optimum conditions.

The very great advantage of this constructional form also resides in that for industrial use a sufficient destruction of germs, fungi and other harmful organisms is achieved simultaneously with the heating and subsequent maintenance at an elevated temperature, since the microwave energy is particularly effective against water-containing harmful organisms.

Figure 14:
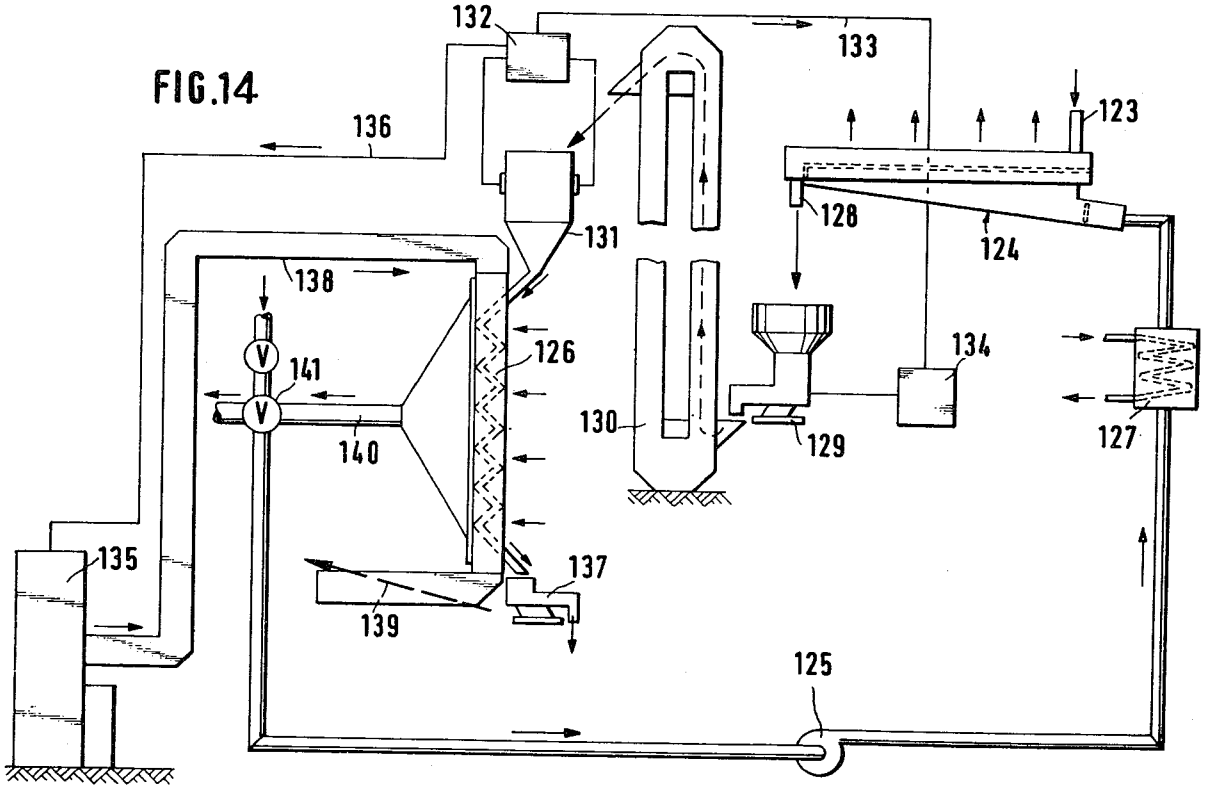
FIG. 14 shows another constructional example of a complete pasta drying installation and FIG. 15 a fragmentary view from a pasta drying installation having only one pre-drying stage, which is followed by a heating stage of the final drying process.

FIG. 14 shows an installation which is suitable for drying and roasting coffee beans, almonds and the like, but may also form part of a pasta drying plant.

Through a conduit 123 a bulk material is fed into a drying unit 124 with a fluidised bed duct. A fan 125 supplies the drying unit 124 with warm air discharged from a microwave heating device 126. The temperature of the warm discharge air can be further increased in a heat exchanger 127. The bulk material issues from the drying unit 124 through a duct 128. Below the latter a vibrating feeder 129 is situated, which transfers the material in dosaged manner to an elevator 130. The elevator 130 itself feeds the bulk material into an intermediate bin 131. The intermediate bin 131 has the task of feeding the bulk material in an always sufficient quantity to the following heating device. The intermediate bin 131 is provided with a lever tester 132 which by way of a line 133 operates an on-off switch 134. The on-off switch 134 closes or opens the supply circuit of the drive of the vibrating feeder 129, so that the vibrating feeder 129 feeds bulk material to the elevator 130 only in accordance with the level in the intermediate bin 131. The intermediate bin 131 is intended to avoid the possibility of the heating device 126 running empty under any circumstances, since otherwise there would be undesirable reflections of the microwaves, which can destroy the microwave generator 135. If the supply of bulk material is interrupted, or if the installation is to be run empty, the level tester 132 sends a signal by way of a line 136 to the microwave generator 135 to switch off. The bulk material is discharged from the heating device 126 by a vibrator 137. As in the constructional example already described, this latter regulates the throughflow speed of the bulk material through the heating device 126. The heating device 126 has a microwave waveguide tube 138 connected with the microwave generator 135. At the end of the tube 138 there is situated the water trap 139, in a manner known per se. Through the waveguide tube 138 air is blown which is collected in a discharge air conduit 140 and is conducted by way of a four-way valve 141 either into the free atmosphere or to the fan 125. If the discharge air is too moist, it is conducted into the free atmosphere, the fan 125 also drawing in its supply air from the free atmosphere.

Figure 15:
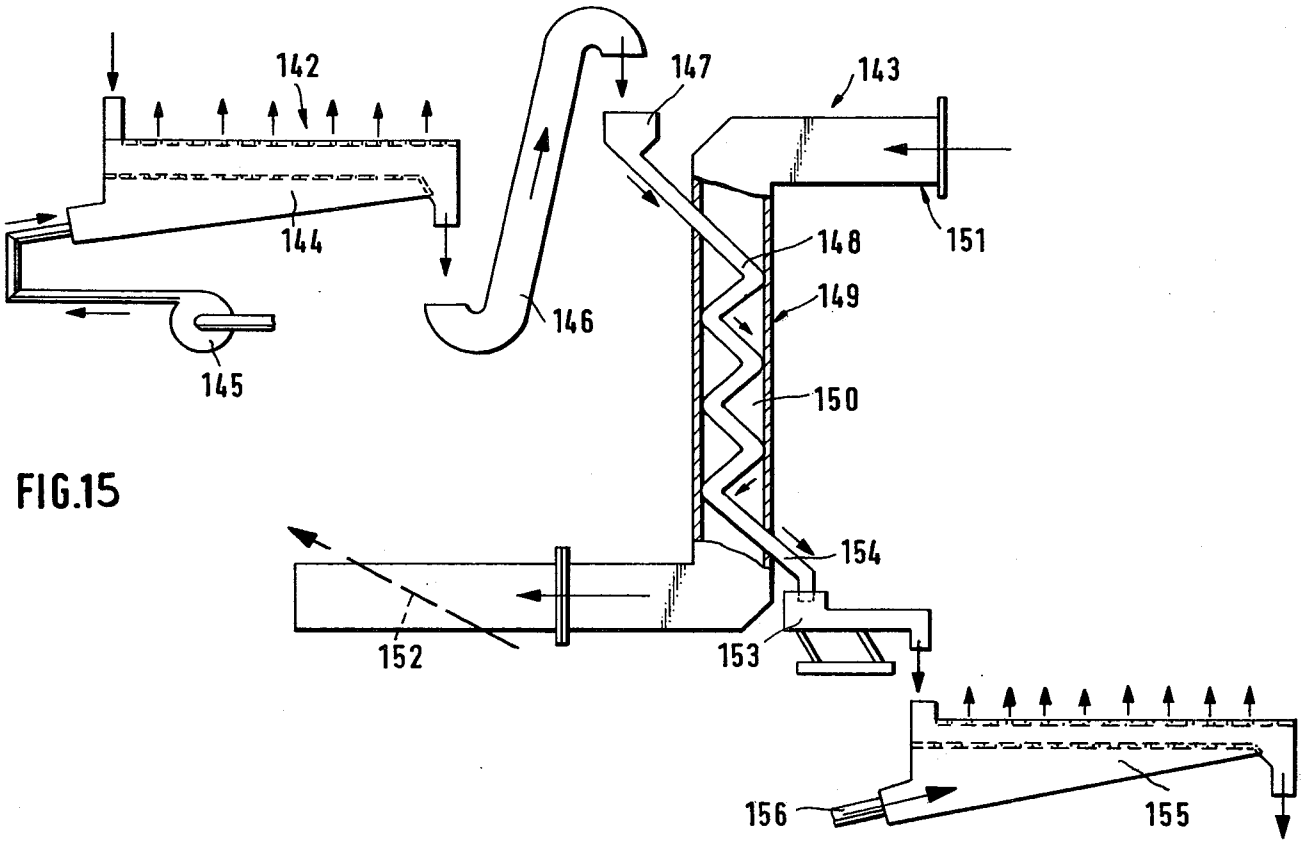

The constructional example shown in FIG. 15 shows a pasta drying plant with pre-dryer 142 and final dryer 143. Pre-dryer 142 and final dryer 143 each comprise a treatment stage, and the treatment stage of the final dryer is sub-divided into a heating step and a drying step. The pasta pieces are first pre-dried in a fluidised bed duct 144 which is supplied with blown air by a fan 145. An elevator 146 takes over the pasta pieces from the duct 144 and transfers them to a feed hopper 147 which is followed by a cascade-form chute 148 of a heating device 149. The chute 148 is arranged in the vertical section 150 of a microwave waveguide tube 151 through which the microwaves pass from above in a downward direction, and non-absorbed microwaves are taken up by a water trap 152. In the chute 148 the pasta pieces are heated and the water present in the interior diffuses to the surface of the piece concerned. The warm pieces sweat. The outlet 154 of the chute 148 co-operates with a vibrator 153 which regulates the quantity of bulk material flowing through the chute 148 i.e. through the effective region of action of the microwaves. The chute 148 may be filled with the bulk material over its entire cross-section or only over a part thereof. The vibrator 153 feeds the pasta pieces into a second fluidised bed duct 155 which is connected via a conduit 156 to the pressure side of the fan 145 or another source of blown air for the production of dry blown air. The fluidised bed ducts 144 and 155 may be arranged in units as shown with reference to FIGS. 3–6. A suitable heating device 149 could be one of the kind shown in FIGS. 9 and 10, and the final dryer may also be constructed in the manner shown in FIGS. 12 and 13.

What we claim and desire to secure by Letters Patent is:

1. A process for bulk drying short pasta products in an air stream, which comprises the steps of forming the products into a bed which extends through a drying zone from an inlet to an outlet thereof, creating a generally upward flow of a gaseous medium, through the bed of products, of such intensity as to continuously fluidize the bed, and augmenting the rotation of the products and their movement relative to one another.

2. A process according to claim 1 including the further step of heating the products while they are in the drying zone.

3. A process according to claim 2 in which the further step comprises acting upon the products by microwaves to heat the products while the gaseous medium flows through said bed, so that points of contact are regularly formed and changed during the conversion of energy in the region where microwaves act whereby changing chains of the products are formed extending parallel to the electrical field of the microwaves.

4. A process according to claim 2 in which the further step comprises heating the products to a temperature at least sufficiently elevated to cause inactivation of harmful organisms.

5. A process according to claim 2 in which the further step includes heating the gaseous medium making up the flow before it passes through the products.

6. A process according to claim 2 in which the further step comprises subjecting the bed or products to microwave energy.

7. A process according to claim 1 in which the last step comprises pulsating the gaseous medium so that is passes in pulsating fashion through the products.

8. A process according to claim 1 which includes an initial step of acting upon the products with mircowaves to heat the products, and an additional step of recycling at least a part of the gaseous medium for repeated flow through said bed.

9. A process for bulk drying pasta products, including but not limited to rolling pieces such as small conical and purse shaped shells, which includes the steps of pre-drying in at least one treatment stage and final drying in at least one treatment stage, wherein at least one of the treatment stages of said pre-drying step includes steps according to claim 1, and wherein at least one of the treatment stages of said final drying step includes initially heating the products.

10. A process according to claim 1 in which the rotation and relative movement of the products are augmented by differently directing the generally upward flow of medium at different sites in said bed.

11. A process according to claim 1 in which the rotation and relative movement of the products are augmented by pulsating the flow of medium at a predetermined frequency.

12. A process according to claim 1 in which the rotation and relative movement of the products are augmented by differently directing the generally upward flow of medium at different sites in said bed, and by pulsating the flow of medium at a predetermined frequency.

13. A process for bulk drying pasta products, including but not limited to rolling pieces such as small conical and purse shaped pasta sheels, which includes the steps of forming the products into a bed which extends through a drying zone from an inlet to an outlet thereof, passing a flow of drying air through said bed, and maintaining the individual products in free motion relative to one another and to the flow of air.

14. A process according to claim 13 which includes the step of forming the products into a throughflow fluidized bed.

15. A process for drying pasta products which includes the initial step of pre-drying said products in at least one treatment stage including steps according to claim 14.

16. A process for drying pasta products which includes the initial step of pre-drying said products in a plurality of treatment stages, the first of which includes steps according to claim 14.

17. A process for drying pasta products which includes the step of final drying said products in at least one treatment stage including steps according to claim 14.

18. A process for drying pasta products which includes the further step of final drying said products prior to the performance of the steps according to claim 14.

19. A process according to claim 18 in which said further step comprises acting upon said products by microwave.

20. A process according to claim 14 which includes the step of heating the products by acting thereupon with microwaves, and the further step of pulsating the flow of gaseous medium through the bed.

21. Method according to claim 20 which includes the step of conveying the material at least approximately horizontally in the region of the microwaves.

22. Method according to claim 21 which includes the step of conveying the material with the middle of the material bed situated at least approximately in the region of the maximum electrical field intensity of the microwaves.

23. Apparatus for treatment of still wet short pasta products comprising, in combination:

at least one turbulence duct having a pasta product inlet, a pasta product outlet, a floor penetrable by air, and air inlet and outlet connections;

a blown air generator having an inlet and an outlet; and air feed and discharge conduit means connecting the air inlet and air outlet of said turbulence duct to the air outlet and inlet respectively of said generator.

24. Apparatus according to claim 23 wherein said blown air generator contains conditioning means for the air.

25. Apparatus according to claim 24 wherein each of said fluidised bed duct forms a closed unit with said air discharge conduit, said blown air generator and said feed conduit.

26. Apparatus according to claim 25 wherein said integral unit is closed by a casing and said air circulation duct is formed at least partly by wall parts of said casing.

27. Apparatus according to claim 26 wherein said casing consists of elements made of 3-layer composite material.

28. Apparatus according to claim 27 wherein said 3-layer composite material comprises a foam plastics insulating material as the middle layer.

29. Apparatus according to claim 27 wherein said 3-layer composite material comprises an aluminium panel which faces the interior of said casing.

30. Apparatus according to claim 27 wherein said 3-layer composite material is secured with the use of adhesives, and said foam plastics material is sealed at the end faces and openings with a spreadable material.

31. Apparatus according to claim 23 wherein said air discharge conduit from said turbulence duct is constructed at least partly as an air circulation duct and is connected to said turbulence duct again in a lower region thereof by way of said blown air generator, and said apparatus further comprising an air pulsator.

32. Apparatus according to claim 31 wherein said air pulsator is situated between said blown air generator and said air-pervious floor.

33. Apparatus according to claim 23 further comprising an air filter and a conditioning means, the air filter being arranged between said fluidised bed duct and said conditioning means.

34. Apparatus according to claim 33 wherein said air filter comprises a mechanically operable separating lock arranged to take out of said air circulation duct any pieces separated out by said air filter.

35. Apparatus for the bulk drying of short pasta products comprising, in combination:

at least one turbulence duct for receiving said products, said duct having a pasta product inlet, a pasta product outlet, and a floor penetrable by a gaseous medium;

means conveying a flow of gaseous medium to said duct through said floor; and means for modifying a characteristic of said flow so that said medium maintains the individual products in free motion relative to one another and to said flow of medium.

36. Apparatus according to claim 35 wherein said floor consists of perforated material, said air perforations are directed obliquely upwards and said floor has a first short section in the region of an inlet aperture wherein the direction of said air throughflow apertures is in the direction of conveyance of said material and a second section wherein the direction of said air throughflow apertures is.

37. Apparatus according to claim 35 wherein below said air-pervious floor there is a two-part pressure chamber comprising an upper pressure chamber bounded by said air-pervious floor and a lower pressure chamber into which a blown air generator discharges, said upper and lower pressure chambers being separated by an air pulsator.

38. Apparatus according to claim 37 wherein said two-part pressure chamber is of cubic shape and said upper and lower pressure chambers are divided by an approximately diagonally extending intermediate wall, and said blown air generator is arranged in a region of larger cross-section and said air pulsator in a region of smaller cross-section of said lower pressure chamber.

39. Apparatus according to claim 35 wherein said turbulence duct is part of a microwave transmitter.

40. Apparatus according to claim 39 comprising a first treatment duct and a second treatment duct, said first treatment duct being part of a microwave transmitter arranged as a heating device, and said second treatment duct being a fluidised bed duct having an air pervious floor for the passage of conditioned air, heating treatment and roasting treatment of one of a range of products comprising coffee, cocoa, nuts and the like obliquely against said direction of conveyance.

41. Apparatus according to claim 40 wherein said first treatment duct is arranged as a wave guide tube and as a fluidised bed duct.

42. Apparatus according to claim 40 wherein said first treatment duct and said second treatment duct share at least in part a common air circulation duct and both said treatment ducts together form an integral unit.

43. Apparatus according to claim 35 wherein said fluidised bed duct comprises a waveguide tube with an electrically non-conductive floor which is pervious to air and which extends from said inlet to said outlet, said apparatus further comprising a microwave generator connected with said waveguide tube.

44. Apparatus according to claim 43 wherein said waveguide tube is perforated above the air-pervious floor, to connect said fluidised bed duct with an air discharge conduit.

45. Apparatus according to claim 43 wherein said wave-guide tube is so positioned relative to said fluidised bed duct that its region of greatest electrical field intensity is situated above the air-pervious floor.

46. Apparatus according to claim 43 wherein said wave guide tube shares at least in part a common air circulation duct with at least one other fluidised bed duct forming part of said apparatus.

47. Apparatus according to claim 35 in which a plurality of said turbulence ducts are connected serially.

48. Apparatus according to claim 47 wherein said pre-dryer comprises a heating device.

49. Apparatus according to claim 48 wherein said heating device is a microwave transmitter.

50. Apparatus according to claim 35 in which the last named means comprises means differently angulating the direction of flow of medium through said floor at different sites therealong.

51. A structure according to claim 35 in which the last named means comprises means pulsating the flow of medium at a predetermined frequency.

52. A structure according to claim 35 in which the last named means comprises means differently angulating the direction of flow of medium through said floor at different sites therealong, and means pulsating the flow of medium at a predetermined frequency.

53. A structure according to claim 35 and means for heating said pasta products while in said turbulence duct.

54. A structure according to claim 53 in which the heating means comprises means for heating the gaseous medium making up said flow.

55. A structure according to claim 53 in which the heating means comprises means projecting microwave energy along said turbulence duct.

56. A pre-dryer for rapidly removing an initial portion of moisture from freshly pressed pasta products, comprising, in combination:

at least one fluidized bed, for traversal by said products, having a floor penetrable by air;

an blown air generator;

means supplying air from said generator to penetrate said floor of said bed;

means for pulsating the flow of air through said floor to cause continual re-arrangement of said products in said bed;

means providing ingress for freshly pressed pasta products to said bed at an inlet location;

means providing egress of partially dried pasta products from said bed at an outlet location;

and means adding heat to said pasta products while in said bed.

57. A final dryer for slowly removing a final portion of moisture from partially dried pasta products, comprising, in combination:

at least one fluidized bed, for traversal by said products, having a floor penetrable by air;

a blown air generator;

means supplying air from said generator to penetrate said floor of said bed;

means for pulsating the flow of air through said floor to cause continual re-arrangement of said products in said bed;

means providing ingress of partially dried pasta products to said bed at an inlet location;

means providing egress of dried pasta products from said bed at an outlet location;

and means adding heat to said pasta products while in said bed.

* * * * *

UNITED STATES PATENT AND TRADEMARK OFFICE

CERTIFICATE OF CORRECTION

PATENT NO. : 4,126,945

DATED : November 28, 1978

INVENTOR(S) : Josef Manser et al.

It is certified that error appears in the above-identified patent and that said Letters Patent are hereby corrected as shown below:

Column 6, line 68, after Fig. 4, insert --parts being omitted for clarity--;

Claim 36, line 8, after "is", insert --obliquely against said direction of conveyance--.

Claim 13, line 3, change "sheel" to --shell--;

Claim 19, line 3, change "microwave" to --microwaves--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*